US007290535B2

(12) United States Patent
Kimura

(10) Patent No.: US 7,290,535 B2
(45) Date of Patent: Nov. 6, 2007

(54) LEAK DIAGNOSTIC DEVICE FOR FUEL VAPOR TREATMENT DEVICE

(75) Inventor: Tamikazu Kimura, Yokohama (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 0 days.

(21) Appl. No.: 11/603,357

(22) Filed: Nov. 21, 2006

(65) Prior Publication Data

US 2007/0113634 A1 May 24, 2007

(30) Foreign Application Priority Data

Nov. 22, 2005 (JP) ..... 2005-336856

(51) Int. Cl.
*F02M 33/02* (2006.01)

(52) U.S. Cl. ..... 123/520; 123/518; 123/519; 73/40; 73/118.1

(58) Field of Classification Search ..... 123/520, 123/519, 518; 73/40, 118.1
See application file for complete search history.

(56) References Cited

U.S. PATENT DOCUMENTS 5,450,834 A * 9/1995 Yamanaka et al. ..... 123/520
5,460,143 A * 10/1995 Narita ..... 123/520
6,164,123 A * 12/2000 Corkill ..... 73/49.7
6,276,343 B1 * 8/2001 Kawamura et al. ..... 123/520
6,367,458 B1 * 4/2002 Furusho et al. ..... 123/519
6,523,398 B1 * 2/2003 Hanai et al. ..... 73/118.1
6,804,995 B2 * 10/2004 Kawano ..... 73/118.1
6,950,742 B2 * 9/2005 Yamaguchi et al. ..... 701/114
6,965,825 B2 * 11/2005 Hosoya et al. ..... 701/114
6,986,341 B2 * 1/2006 Mitani et al. ..... 123/520
2001/0054415 A1 * 12/2001 Hanai et al. ..... 123/520
2002/0046609 A1 * 4/2002 Ito ..... 73/700
2007/0113633 A1 * 5/2007 Kimura ..... 73/118.1

FOREIGN PATENT DOCUMENTS

JP 06-173789 6/1994

* cited by examiner

*Primary Examiner*—Stephen K. Cronin
*Assistant Examiner*—J. Page Hufty
(74) *Attorney, Agent, or Firm*—Young Basile Hanlon MacFarlane & Helmholdt, P.C.

(57) ABSTRACT

A lag time is set in a period from the time when a leak down is finished to the time when measurement of the amount of fuel vapor is started for the purpose of returning a deformed fuel tank to its original shape. A fuel vapor amount estimating means is provided that estimates the amount of fuel vapor produced in the fuel tank during the time of the leak down. This means is so set as to make the lag time shorter as the amount of fuel vapor increases. With this, undesired precision in measuring the amount of fuel vapor produced under a condition wherein the amount of fuel vapor is large can be avoided.

13 Claims, 6 Drawing Sheets

LEAK DIAGNOSTIC DEVICE FOR FUEL VAPOR TREATMENT DEVICE

CROSS REFERENCES TO RELATED APPLICATIONS

This application claims priority from Japanese Patent Application Serial No. 2005-336856, filed on Nov. 22, 2005, which is incorporated herein in its entirety by reference.

TECHNICAL FIELD

The present invention relates to leak diagnostic devices for fuel vapor treatment devices.

BACKGROUND

In a fuel vapor treatment device for an internal combustion engine, the fuel vapor in a fuel tank is led into a canister to be temporarily adsorbed by the same, and the fuel vapor adsorbed by the canister is then led into an intake system of an internal combustion engine through a purge valve together with fresh air introduced from a fresh air inlet opening, thereby suppressing the escape of fuel vapor to open air.

In fuel vapor treatment devices of the type mentioned hereinabove, if the piping of a purge line extending from the fuel tank to the purge valve through the canister is cracked or poorly sealed at the joint portion of the piping, leakage of the fuel vapor is induced, preventing the fuel vapor treatment device from exhibiting sufficient fuel vapor escape suppression performance.

There are known leak diagnostic devices. For example, Japanese Laid-open Patent Application (Tokkaihei) 6-173789, discloses a leak diagnostic device that diagnoses or checks whether there is a leak of fuel vapor from the purge line or not by the change in pressure. The device performs a leak down detection operation wherein a predetermined amount of engine negative pressure is introduced, the purge line is hermetically closed up, and a determination is made whether there is a leak based on the change in pressure of the purge line. After the hermetical closing-up of the purge line, the internal pressure changes due to continuous vaporization of fuel in the fuel tank. The negative pressure change caused by the leak down is measured, and the interior of the purge line is exposed to the atmospheric air. The purge line is hermetically closed again, and the increase of internal pressure in the piping caused by the atmospheric pressure is detected to perform a vapor monitoring treatment for measuring a production speed of the fuel vapor. Based on the result of the measurement, the pressure variation at the leak down is corrected to increase leak detection performance.

BRIEF SUMMARY

A leak diagnostic apparatus for an internal combustion engine as taught herein can include a canister having an air inlet opening, the canister temporarily absorbing fuel vapor produced in a fuel tank, a fuel vapor passage extending from the fuel tank to the canister, a purge passage extending from the canister to an intake manifold of the internal combustion engine, a purge valve for opening and closing the purge passage, a cut valve for opening and closing the air inlet opening and a leak diagnostic control unit for diagnosing a fuel vapor leak in a purge line extending from the fuel tank to the purge valve through the canister. The leak diagnostic control unit is operable to detect a pressure in the purge line, to measure a first pressure change rate of the purge line after a predetermined negative pressure is applied to the purge line and the purge valve and cut valve are closed, sealing the purge line at the predetermined negative pressure, to measure a second pressure change rate of the purge line after measuring the first pressure change rate, opening the cut valve to expose the purge line to atmospheric conditions, passing a predetermined lag time and closing the purge valve and the cut valve, to determine a leak degree based on a difference between the first pressure change rate and the second pressure change rate, to estimate a fuel vapor amount wherein the fuel vapor amount is an amount of fuel vapor produced during a time the first pressure change rate is being measured and to shorten the predetermined lag time as the fuel vapor amount increases.

Another leak diagnostic apparatus taught herein comprises a canister having an air inlet opening and receiving fuel vapor produced in a fuel tank, a fuel vapor passage extending from the fuel tank to the canister, a purge line extending from the fuel tank to a purge valve through the canister, means for detecting a pressure in the purge line, means for measuring a first pressure change rate of the purge line, means for measuring a second pressure change rate of the purge line after measuring the first pressure change rate and after a variable lag time, the variable lag time dependent on at least one of a pressure at a finish of a leak down operation and a fuel temperature, means for determining a leak degree based on a difference between the first pressure change rate and the second pressure change rate, means for estimating a fuel vapor amount wherein the fuel vapor amount is an amount of fuel vapor produced during a time the first pressure change rate is being measured and means for shortening the variable lag time as the fuel vapor amount increases.

Methods for diagnosing a leak for use in a fuel vapor treatment device are also taught herein. The fuel vapor treatment device has a canister for absorbing fuel vapor directed from a fuel tank by a fuel vapor passage. The canister has an air inlet for receiving atmospheric air. The inlet is opened and closed by a cut valve. A purge line extends from the fuel tank to a purge valve through the canister. The method comprises detecting pressure in the purge line, applying a predetermined negative pressure to the purge line, sealing the purge line at the negative pressure, measuring a first pressure change rate of the purge line, exposing the purge line to atmospheric air, sealing the purge line at the atmospheric pressure after passage of a predetermined lag time, measuring a second pressure change rate of the purge line, determining a degree of leak based on a difference between the first pressure change rate and the second pressure change rate, estimating a fuel vapor amount wherein the fuel vapor amount is an amount of fuel vapor produced during a time the first pressure change rate is being measured and shortening the variable lag time as the fuel vapor amount increases.

Other variations of the apparatus, and additional methods, are described hereinafter.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
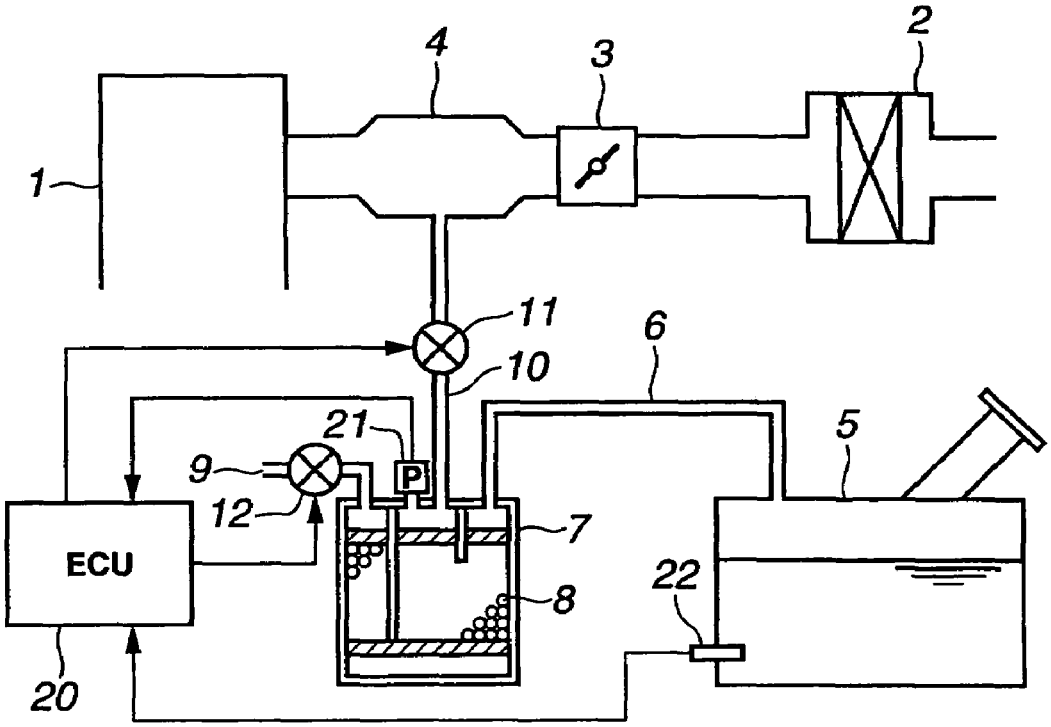
FIG. 1 is a system diagram illustrating an example of the invention.

With the leak diagnosis device of Japanese Patent Application No. 6-173789, when the purge line is fed with the negative pressure the fuel tank is subjected to a deformation due to the force of the negative pressure. When the deformed fuel tank is returned to its original shape, the leak detecting performance is affected. That is, in the leak down the change of internal pressure is measured as the negative pressure is applied to the purge line, and thus the effect of the deformation of the fuel tank is small. During vapor monitoring treatment, the internal pressure of the purge line is set to the atmospheric value or initialized in advance in order to accurately measure the amount of fuel vapor produced. As the fuel tank is deformed, a pressure buildup due to the fuel vaporization and a negative pressure due to reversion of the fuel tank are canceled from each other, making the precise detection of the fuel vapor amount difficult.

As described herein, in a fuel vapor treatment device wherein the fuel vapor in a fuel tank is directed into a canister having a fresh air inlet opening to be temporarily adsorbed by the same and the fuel vapor adsorbed by the canister is directed into an intake system of an internal combustion engine through a purge valve together with fresh air introduced from the fresh air inlet opening, the leak diagnostic device diagnoses a leak of fuel vapor from a purge line that extends from the fuel tank to the purge valve through the canister. That is, the purge line is a closed space formed by interior space of components that enclose the fuel vapor, for example, the interior space of the fuel tank and the canister.

The leak diagnostic device can include a cut valve that opens and closes the fresh air inlet opening of the canister and a pressure detecting means that detects the pressure in the purge line.

As respective means for carrying out operation of the leak down and vapor monitoring, there are provided a first pressure change rate measuring means and a second pressure change rate measuring means.

In the first pressure change rate measuring means, after the purge line is fed with a predetermined negative pressure, both the purge valve and the cut valve are closed. A first pressure change rate of the purge line, which is in a negatively pressurized and hermetically closed condition, is measured by the pressure detecting means.

In the second pressure change rate measuring means, after the first pressure change rate is measured by the first pressure change rate measuring means, the cut valve is opened to expose the interior of the purge line to open air, and after passage of a predetermined lag time, both the purge valve and cut valve are closed. A second pressure change rate of the purge line, which is hermetically closed and filled with atmospheric pressure, is measured by the pressure detecting means.

A degree of leak of the purge line is judged by a leak judging means based on a difference between the first pressure change rate and the second pressure change rate.

A feature of the invention is to provide a fuel vapor amount estimating means that estimates the amount of fuel vapor produced during a time for which the first pressure change rate is being measured and shortens the predetermined lag time as the estimated amount of fuel vapor produced increases.

According to embodiments of the leak diagnostic device herein, a lag time, which is the time from when the measurement of a first pressure rate is finished and a cut valve is opened to expose the interior of the purge line to atmospheric air, to the start of the measurement of a second pressure change rate (when the purge valve and the cut valve are closed), is variably set based on the estimated fuel vapor produced during measurement of the first pressure change rate. The predetermined lag time is reduced as the estimated amount of fuel vapor produced increases. Therefore, a minimum lag time is set based on the estimated fuel vapor amount, and high accuracy leak detection results.

Referring now to the figures, in an intake system of an internal combustion engine 1, arranged in a direction from the upstream to the downstream, is an air cleaner 2, a throttle valve 3 and an intake manifold 4. The supply of fuel is performed by a fuel injection valve (not shown) provided for each cylinder.

As shown in FIG. 1, the fuel vapor treatment device comprises a canister 7 that temporarily adsorbs a fuel vapor that is produced in a fuel tank 5 and directed through a fuel vapor induction passage 6 to the canister 7. Canister 7 includes a case filled with adsorbent, such as activated charcoal 8 or the like.

Canister 7 has an air inlet opening 9, which exposes the canister 7 to atmospheric air, and a purge passage 10 extending from the canister 7. Purge passage 10 is connected through a purge valve 11 to intake manifold 4 arranged downstream of throttle valve 3. Purge valve 11 is constructed to open upon receiving a signal from a controller, such as an engine control unit (referred as ECU hereafter) 20.

The fuel vapor produced in fuel tank 5 during standstill of internal combustion engine 1 is led into canister 7 through fuel vapor induction passage 6 and is adsorbed by the canister 7. When the internal combustion engine 1 is started, a predetermined purge permission condition is established, the purge valve 11 is opened, and a negative pressure intake of the internal combustion engine 1 is applied to canister 7. The fuel vapor adsorbed by canister 7 is desorbed from the canister 7 with the aid of the air introduced from air inlet opening 9. The purge gas containing the desorbed fuel vapor is led through purge passage 10 into intake manifold 4, and then combusted or treated in the combustion chambers of internal combustion engine 1.

The fuel vapor treatment device includes a cut valve 12 that is connected to the air inlet opening 9 of canister 7 for opening and closing the air inlet opening 9.

According to the example shown, the controller is an ECU 20. Hence, the controller is a standard engine microcontroller that includes a central processing unit (CPU), random access memory, read only memory and input/output ports receiving input signals and sending output signals as discussed in more detail below. The functions described herein are generally programming instructions stored in memory and are performed by the logic of the CPU. Of course, the controller that performs the functions described herein could also be part of a dedicated microcontroller or could be a microprocessor using external memory. As described according to an example of the invention, the ECU 20 performs the functions of measuring a first pressure change rate, measuring a second pressure change rate, determining an existence of a leak, estimating fuel vapor amount and detecting a degree of tank deformation. The ECU 20, based on a predetermined leak diagnostic condition, performs diagnosis of a leak while controlling the opening and closing of purge valve 11 and cut valve 12. In performing the leak diagnosis, various signals, which are issued from a pressure sensor 21 detecting pressure and a fuel temperature sensor 22 detecting fuel temperature, are sent to the ECU 20.

Pressure sensor 21 is exposed to an interior of canister 7 in order to detect the pressure in the purge line, which extends from fuel tank 5 to purge valve 11 through canister 7. Hence, in this example, the purge line is formed by the interior space of the fuel tank 5, the fuel vapor passage 6, the canister 7 and a part of the purge passage 10 (between the canister 7 and the purge valve 11). Fuel temperature sensor 22 is exposed to an interior of fuel tank 5 in order to detect the temperature of fuel.

Figure 2:
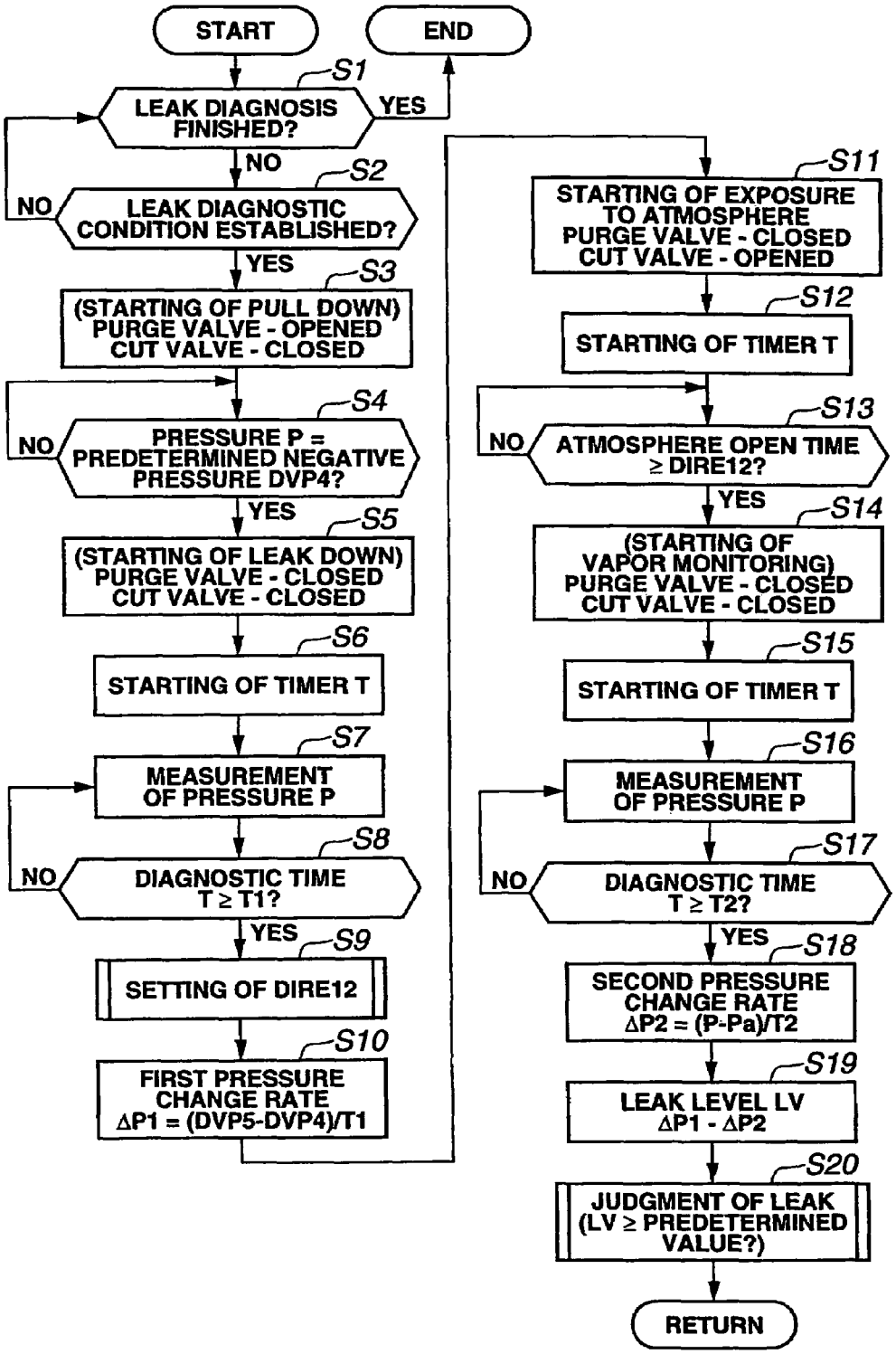
FIG. 2 is a flowchart illustrating the process of diagnosing a leak.
Figure 3:
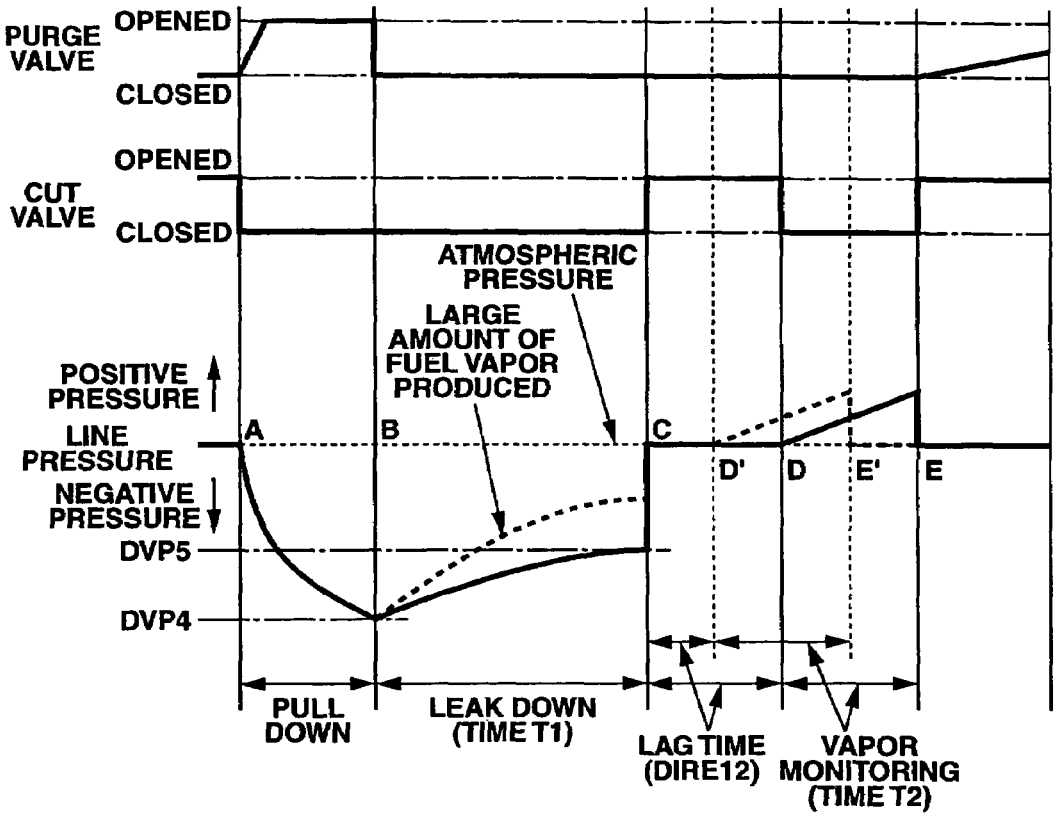
FIG. 3 is a time chart illustrating the diagnosis of a leak.

The flow chart of FIG. 2 and the time chart of FIG. 3 illustrate the operation of the leak diagnosis executed by a controller, such as ECU 20, of the fuel vapor treatment device. In step (denoted as S hereafter) 1, a determination is made as to whether the leak diagnosis is finished or not. If the leak diagnosis is not complete, the process proceeds to S2. If the leak diagnosis is complete, the treatment is finished.

In S2, a determination is made as to whether a predetermined leak diagnostic condition is established. More specifically, based on the operational conditions and the drive or operational history, the predetermined leak diagnosis condition is satisfied if the purging of the fuel vapor can be stopped, there is no sloshing effect (excessive vaporization caused by vibration), and a negative pressure can be obtained in the intake system. The process proceeds to S3 when the leak diagnostic condition is satisfied.

A pull down operation for applying a negative pressure to the purge line is next performed in S3. During the pull down operation, the purge valve 11 is opened and cut valve 12 is closed (see point "A" of FIG. 3).

In S4, pressure P of the purge line detected by pressure sensor 21 is read. A determination is made as to whether the pressure P has reached a predetermined diagnosis-start negative pressure DVP4. When the pressure P reaches the predetermined diagnosis-start negative pressure DVP4, the process proceeds to S5 for the diagnosis treatment starting with a leak down operation.

The diagnosis begins at S5 where a first predetermined pressure change rate is measured. The purge valve 11 is closed and the cut valve 12 remains closed (see point "B" of FIG. 3). During this step, the purge line comes into a negatively pressurized and hermetically closed condition. Then, the purge line is gradually increased depending on the degree of leakage (leak bore diameter) from the purge line and the amount of fuel vapor produced.

In S6, a diagnosis time timer is reset to start time measurement from the time that the diagnosis is started.

In S7, the pressure P in the purge line detected by pressure sensor 21 is read as part of the diagnosis operation.

In S8, a determination is made as to whether the diagnosis time T counted by the diagnosis timer has reached a predetermined leak down time T1. If a determination is made that the diagnosis time has not reached the predetermined leak down time, the process returns to S7. During the diagnosis operation, S7 and S8 are repeated until the time elapsed since the start of the leak down (i.e., diagnosis time T), reaches the preset time T1 (see point "C" of FIG. 3).

Once diagnosis time T is equal to or greater than preset time T1, the leak down operation is finished. The process proceeds to S9.

After this leak down operation, a vapor monitoring treatment begins. Prior to this, in S9 a lag time DIRE12 is set. The lag time DIRE 12 is the time from when the leak down operation is finished to the time when measuring the second pressure change rate is started. Setting of DIRE 12 will be described in detail hereinafter.

In S10, an amount of pressure change produced during the leak down is derived by subtracting the diagnosis starting pressure DVP4 from a diagnosis finishing pressure DVP5. The pressure change is divided by the diagnosis time T1 to obtain a first pressure change rate:

$$\Delta P1=(DVP5-DVP4)/T1 \quad (1)$$

This rate depends on the degree of leakage and the amount of fuel vapor produced.

In S11, the purge line is exposed to atmospheric air by opening the cut valve 12 while the purge valve 11 remains closed.

In S12, the timer is reset when the purge line is exposed to the atmospheric air. After the timer is reset in S12, in S13 a determination is made as to whether the time elapsed from the time when the purge line was exposed to the atmospheric air has reached the set lag time DIRE12. When the timer value T reaches or exceeds the value DIRE12, the process proceeds to S14 (see point D of FIG. 3).

The cut valve 12 is closed, and the purge valve 11 remains closed in S14. The vapor monitoring starts with the measurement of the second pressure change rate. During this step the purge line is sealed at atmospheric pressure, and the pressure in the purge line is gradually increased as the amount of fuel vapor produced increases.

In S15, the timer T is reset for measuring the vapor monitoring time from the start of vapor monitoring.

The purge line pressure P detected by pressure sensor 21 is read in S16.

In S17, a determination is made as to whether the diagnosis time T measured by the timer has reached a predetermined diagnosis time T2. If not, the operation returns to S16. During the diagnosis operation, S16 and S17 are repeated until the diagnosis time T reaches T2 (see point "E" in FIG. 3). Then the process proceeds to S18.

In S18, the amount of pressure change over the diagnosis time is derived by subtracting the measured pressure (atmospheric pressure) Pa at the start of measurement from the pressure P at the end of measurement. Then the pressure change result is divided by the diagnosis time T2 to obtain a second pressure change rate ΔP2. This rate depends only on the amount of fuel vapor produced.

In S19, the second pressure change rate ΔP2 is subtracted from the first pressure change rate ΔP1 to derive a leak level LV, which is a pressure rate change that depends only on the degree of leakage (leak hole diameter). Although in this example the leak level is obtained from the pressure change, which is derived by dividing the pressure variation during the leak down ΔP1 by the diagnostic time T1 and dividing the pressure variation during the vapor monitoring ΔP2 by the diagnosis time T2, the leak level LV may also be obtained based on the respective pressure variations without dividing the pressure variation by the diagnosis times T1, T2.

In the next step S20, the leak level LV is compared with a predetermined value to determine whether there is a leak. If the leak level LV is equal to or greater than the predetermined value, a leak is present. If the leak level LV is less than the predetermined value, a leak is not present.

After the diagnosis, purge valve 11 is opened or closed depending on whether purging is requested, and the cut valve 12 is opened.

The setting of the above-mentioned lag time DIRE12 is aimed to ensure a certain atmospherically open time during the time period from when the measuring of the first pressure change rate (leak down) is finished to the time when the measuring of the second pressure change rate (vapor monitoring) is started and to ensure sufficient restoration of the fuel tank during the atmospherically open time. If the atmospherically open time is too long, there is an inconsistency between the first pressure change rate and the second pressure change rate under a condition where, like at upper atmospheric conditions, the fuel evaporation is high, causing errors to arise in the leak diagnosis. Accordingly, the lag time DIRE12 corresponding to the atmospherically open time is shortened as the amount of fuel vapor produced increases so that the atmospheric exposing time can be limited to the time that is actually necessary.

Because the amount of fuel vapor at the time of measuring the first pressure change rate correlates to the pressure of the purge line, the amount of fuel vapor produced is estimated based on DVP5, that is the pressure value detected by pressure sensor 21 when the measurement of the first pressure change rate is completed.

Figure 4:
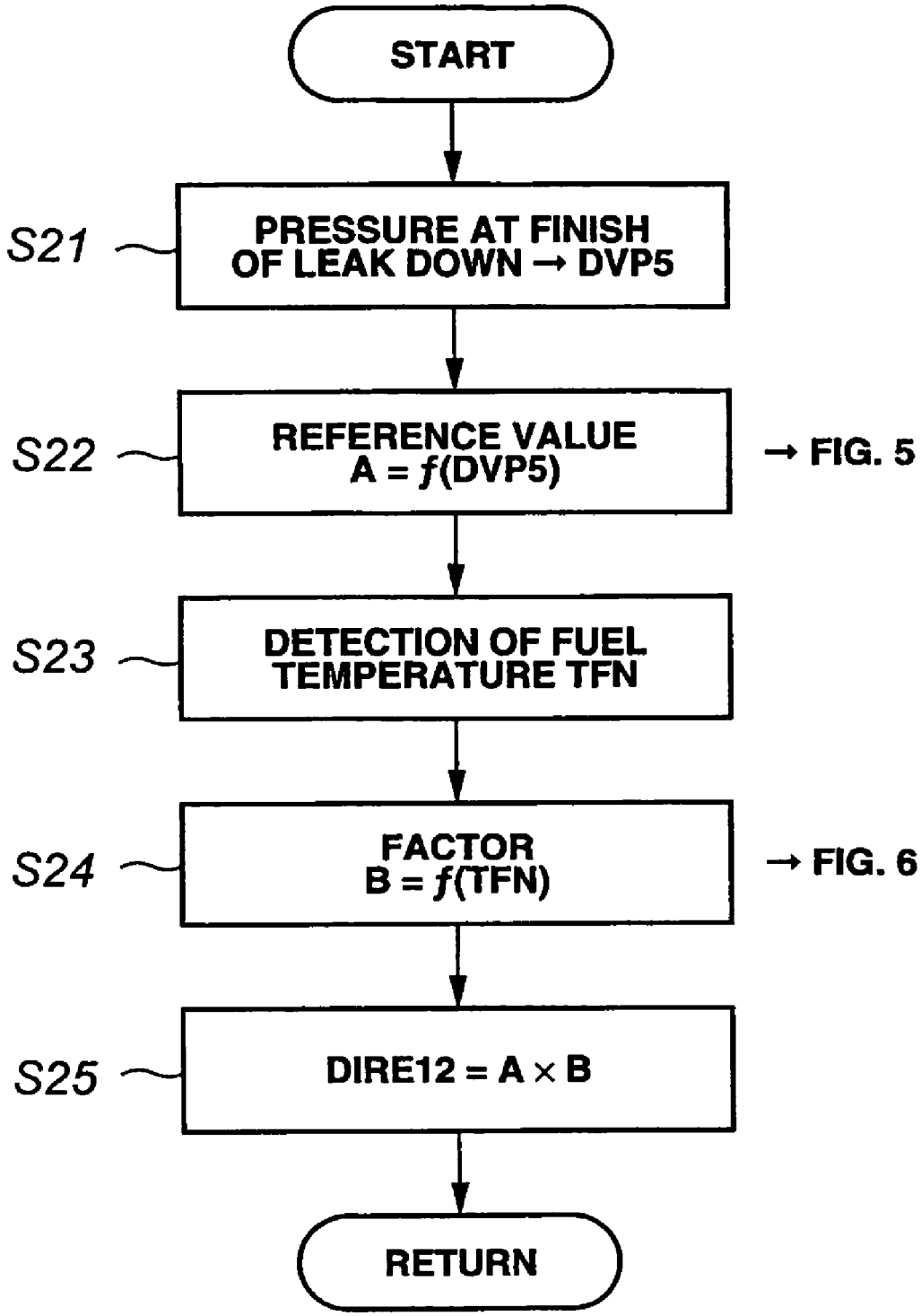
FIG. 4 is a flowchart illustrating setting a lag time.

Referring now to FIG. 4, which illustrates the steps executed during the process of the leak diagnosis treatment by ECU 20 (S9 of FIG. 2), the pressure at the time (see point C of FIG. 3) when the measurement of the first pressure change rate is finished is derived as the value DVP5 based on the signal from pressure sensor 21. The leak diagnosis then proceeds to S21 where the value DVP5 is referenced.

Figure 5:
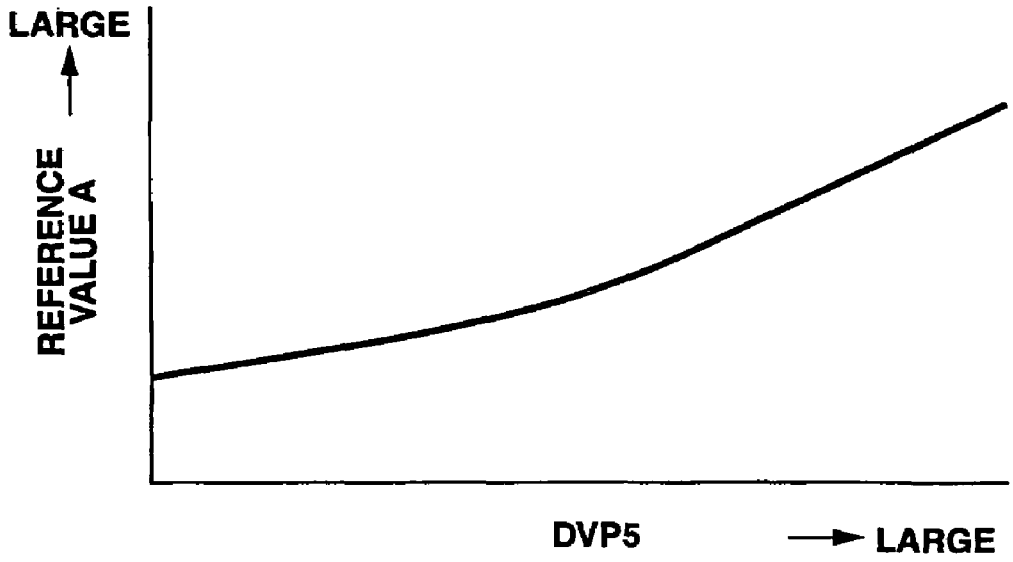
FIG. 5 is a graph illustrating a relationship between the internal pressure of the purge line and a reference value of lag time.

In S22, by using a table populated with the characteristics illustrated in FIG. 5 with reference to the value DVP5, a value A representing a reference value of the estimated amount of fuel vapor produced is established from the table. The characteristics of FIG. 5 are the results of an experiment for examining a relationship between the value DVP5 and the amount of fuel vapor produced in a fuel supply system and the fuel vapor treatment device that were the subject of the leak diagnosis. The relationship is stored in the ECU 20 as a data table. As is understood from FIG. 5, as DVP5 increases, that is, as the negative pressure value increases, the value A increases. This phenomenon corresponds to the characteristic that the lag time increases as the amount of fuel vapor produced decreases. The leak diagnosis proceeds to S23.

In S23, based on a signal from fuel temperature sensor 22, fuel temperature TFN in fuel tank 5 is detected. The leak diagnosis then proceeds to S24.

Figure 6:
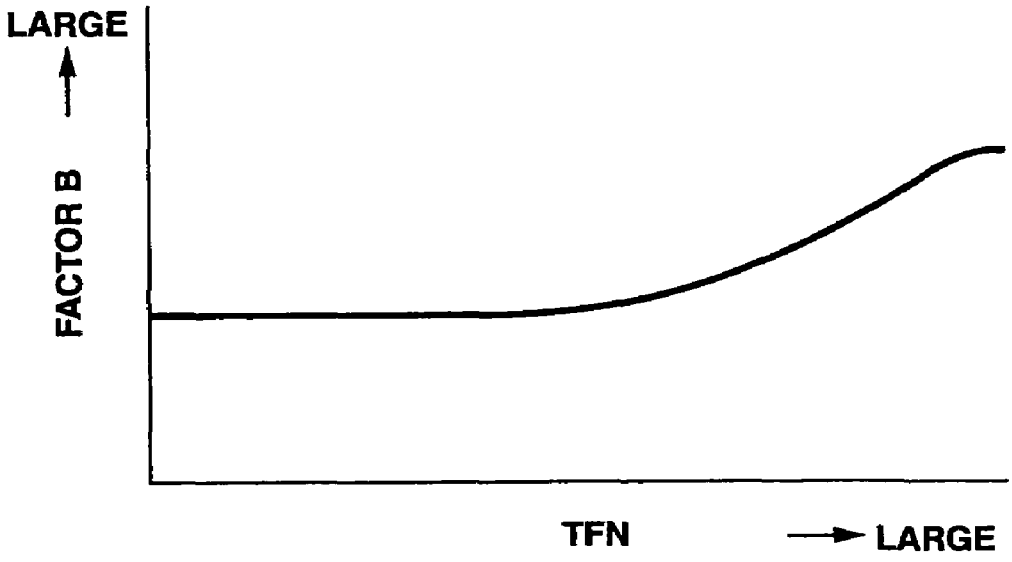
FIG. 6 is a graph illustrating a relationship between a fuel temperature and a correction factor.

In S24, by using a table populated with the characteristics shown in FIG. 6 with reference to the detected fuel temperature TFN, a correction factor B for the reference value A is established from the table. The correction factor B corresponds to a deformation characteristic of fuel tank 5 to temperature, that is, to a variation of restoring force. Particularly in a plastic fuel tank, the deformation degree of the tank easily changes by temperature. With reference to a relationship between the temperature and the deformation degree, the factor B is derived experimentally and stored in ECU 20 as a table. In general with an increase in temperature, the deformation degree of the fuel tank increases, and thus, longer time is needed for restoration of the fuel tank. Accordingly, as is shown in FIG. 6, as the detected fuel temperature TFN increases, the correction factor B increases, and the reference value A is corrected by an increase.

In S25, the lag time DIRE12 is set as the result of multiplying the reference value A by the factor B, and the leak diagnosis is completed.

As illustrated in FIG. 3, the above-mentioned setting of lag time DIRE12 varies in accordance with the amount of fuel vapor produced.

In the pull down step of the operation, in which the purge line is fed with negative pressure to the leak down, the fuel tank is subjected to a deformation because of the application of negative pressure.

Accordingly, after the leak down but before the start of the subsequent vapor monitoring treatment, the lag time DIRE12 is set. A certain amount of atmospheric pressure is also let into the fuel tank to sufficiently restore the fuel tank, so that when the vapor monitoring is started the internal pressure of the purge line assuredly shows the level of the atmospheric pressure.

As has been explained hereinabove and illustrated in FIG. 4, the lag time DIRE12 is set shorter as the amount of fuel vapor produced in the leak down state increases. The broken line in FIG. 3 indicates the variation characteristic of the internal pressure in conditions, such as high altitudes, where the amount of fuel vapor produced is large. As compared with a condition of lowlands, i.e., low altitudes, where the amount of fuel vapor produced is small as is indicated by solid line, the negative pressure DVP5 at the time when the leak down is finished is small. Thus, the lag time DIRE12 is shortened, and as compared with the case of higher altitudes, the treatment of the vapor monitoring is started early.

If the purpose is intended only to return the purge line pressure to the atmospheric level upon restoration of the fuel tank, it is only necessary to provide a sufficiently long lag time DIRE, that is, it is only necessary to wait the period of time for the fuel tank to be sufficiently restored. However, if such measure is actually made, the production speed of the fuel vapor is largely varied under a condition where, like at the highlands, the amount of fuel vapor produced is increased, and thus, a precise leak detection is not always achieved only by increasing the time for which the interior of the purge line is kept exposed to the atmosphere.

In the process from the pull down step of feeding the interior of the purge line with a negative pressure to the leak down, the fuel evaporates relatively actively, and as the time passes, the amount of fuel vapor produced gradually reduces. This is illustrated at the highlands, where the amount of fuel vapor produced is increased, and as is seen in FIG. 7, the rising of the fuel vapor produced at the highlands is sharp as compared with that at the lowlands.

Figure 7:
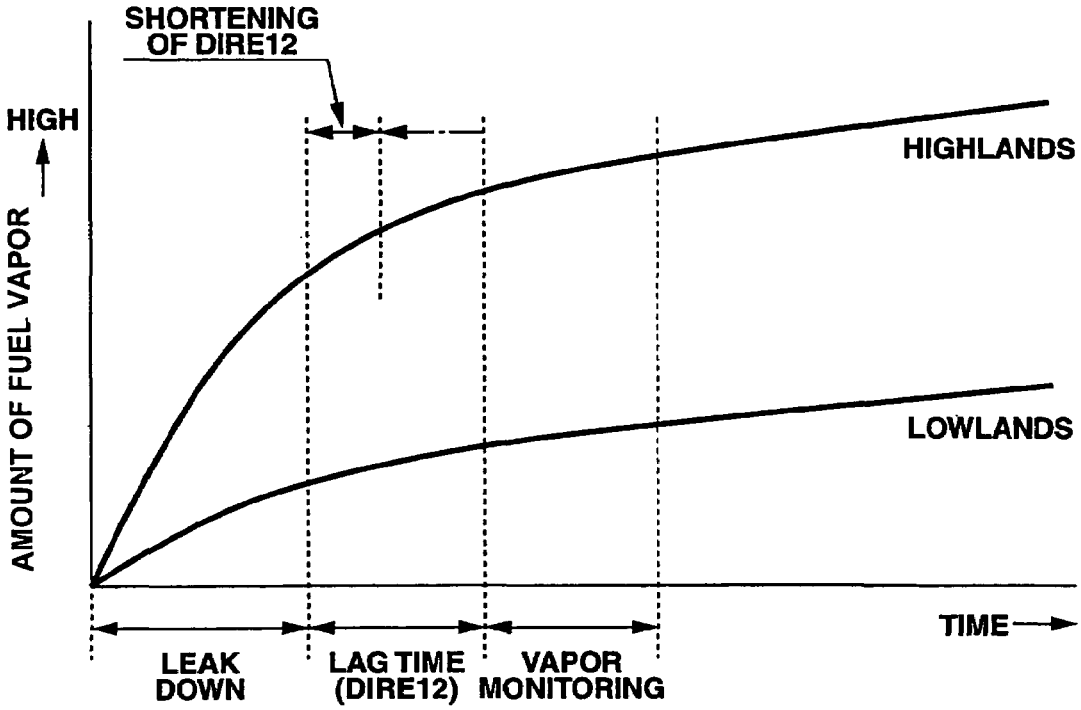
FIG. 7 is graph illustrating the characteristics of fuel vaporization.

Accordingly, as is shown in FIG. 7, where the lag time DIRE12 from the end of the leak down to the start of the vapor monitoring is made constant, at high altitudes (or highlands) the production speed of the fuel vapor (i.e., the evaporation rate) detected at the leak down period and at the vapor monitoring period largely differ from each other, so that the amount of fuel vapor produced at the leak down period is underestimated, causing errors of the leak diagnosis.

In the example of the invention described hereinabove, in a condition where the amount of fuel vapor produced is large, the lag time DIRE12 is shortened, and thus, errors caused by the characteristic of the fuel vapor production are reduced, and the precision of the leak diagnosis is improved.

Shortening the lag time DIRE12 means that the time needed for restoring the fuel tank is reduced. However, as is seen from FIG. 3, when the amount of fuel vapor produced is large, the negative pressure in the leak down period is suitably reduced, and thus the deformation of the fuel tank is small. Even when the lag time DIRE12 is shortened, the fuel tank can be sufficiently restored until the time when the vapor monitoring is started.

In the controller of the example, a correction is made based on the fuel temperature TNF and the lag time DIRE12 is increased as the fuel tank shows a higher temperature wherein it is easily deformed (see FIG. 6). Accordingly, the lag time can be precisely set or determined in accordance with variation of the deformation of the fuel tank that depends on the temperature.

In the above-mentioned controller, the amount of fuel vapor produced is estimated based on the internal pressure DVP5 of the purge line when the leak down is finished, and thus, the lag time DIRE12 is shortened as in a situation where the reduction of the internal pressure is caused by a leak. However, even when the pressure reduction is caused by a leak, the restoration of the fuel tank is similarly carried out, and as a result the shortening of the lag time DIRE12 does not affect the vapor monitoring.

The amount of fuel vapor produced can be directly detected by a sensor and using the directly detected value, the control may be carried out based on the actual amount of fuel vapor produced. The diagnosis precision may be increased or improved by repeatedly carrying out the process of the leak diagnosis shown FIG. 2, that is, by carrying out, in a second leak diagnosis process, the diagnosis with an application of the lag time DIRE12 derived by the process of FIG. 4 only when the leak bore diameter has been found smaller than a predetermined allowable value in a first leak diagnosis process.

In the above-mentioned example, the amount of fuel vapor produced in the fuel tank is estimated for setting the lag time DIRE12. Alternatively, by directly detecting the deformation degree of the fuel tank with the aid of a strain gauge or the like, a control may be carried out based on the result of the detection so that the lag time DIRE12 is increased as the deformation degree of the fuel tank increases. The deformation degree of the fuel tank depends mainly on the negative pressure applied to the interior of the fuel tank. Thus, when the design specification of the fuel tank is known, a relation between the negative pressure and the deformation degree or the time needed for the restoration of the fuel tank may be obtained by experiments and stored in a control system. Since in this situation the internal pressure of the purge line can represent the deformation degree of the fuel tank, the variable setting of the lag time DIRE12 can be accomplished by using a technique that is identical to that illustrated in FIG. 2.

Also, the above-described examples have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A leak diagnostic apparatus for an internal combustion engine, the apparatus comprising:

a canister having an air inlet opening, the canister temporarily absorbing fuel vapor produced in a fuel tank;

a fuel vapor passage extending from the fuel tank to the canister;

a purge passage extending from the canister to an intake system of the internal combustion engine;

a purge valve for opening and closing the purge passage;

a cut valve for opening and closing the air inlet opening; and a leak diagnostic control unit for diagnosing a fuel vapor leak in a purge line extending from the fuel tank to the purge valve through the canister, the leak diagnostic control unit operable to:

detect a pressure in the purge line;

measure a first pressure change rate of the purge line after a predetermined negative pressure is applied to the purge line and the purge valve and cut valve are closed, sealing the purge line at the predetermined negative pressure;

measure a second pressure change rate of the purge line after measuring the first pressure change rate, opening the cut valve to expose the purge line to atmospheric conditions, passing a predetermined lag time and closing the purge valve and the cut valve;

determine a leak degree based on a difference between the first pressure change rate and the second pressure change rate;

estimate a fuel vapor amount wherein the fuel vapor amount is an amount of fuel vapor produced during a time the first pressure change rate is being measured; and shorten the predetermined lag time as the fuel vapor amount increases.

2. The apparatus according to claim 1 wherein the leak diagnostic control unit is further operable to:

increase the predetermined lag time as a negative pressure of the purge line increases when measurement of the first pressure change rate is completed.

3. The apparatus according to claim 2 wherein the increase of the predetermined lag time is based on the detected pressure.

4. The apparatus according to claim 1 wherein the leak diagnostic control unit is further operable to:

detect a temperature of fuel in the fuel tank; and increase the predetermined lag time as the fuel temperature increases, the increase in the predetermined lag time being based on the detected fuel temperature.

5. A leak diagnostic apparatus for an internal combustion engine, the apparatus comprising:

a canister having an air inlet opening and receiving fuel vapor produced in a fuel tank;

a fuel vapor passage extending from the fuel tank to the canister;

a purge line extending from the fuel tank to a purge valve through the canister;

means for detecting a pressure in the purge line;

means for measuring a first pressure change rate of the purge line;

means for measuring a second pressure change rate of the purge line after measuring the first pressure change rate and after a variable lag time, the variable lag time dependent on at least one of a pressure at a finish of a leak down operation and a fuel temperature;

means for determining a leak degree based on a difference between the first pressure change rate and the second pressure change rate;

means for estimating a fuel vapor amount wherein the fuel vapor amount is an amount of fuel vapor produced during a time the first pressure change rate is being measured; and means for shortening the variable lag time as the fuel vapor amount increases.

6. The apparatus according to claim 5, further comprising:

means for increasing the variable lag time as a negative pressure of the purge line increases when the means for measuring the first pressure change rate completes measuring the first pressure change rate.

7. The apparatus according to claim 5 wherein the means for measuring the first pressure change rate further comprises means for measuring the first pressure change rate after a predetermined negative pressure is applied to the purge line when the purge line and the air inlet valve are closed.

8. A method for diagnosing a leak for use in a fuel vapor treatment device having a canister for absorbing fuel vapor directed from a fuel tank by a fuel vapor passage, the canister having an air inlet for receiving atmospheric air, the inlet opened and closed by a cut valve, and a purge line extending from the fuel tank to a purge valve through the canister, the method comprising:

detecting pressure in the purge line;

applying a predetermined negative pressure to the purge line;

sealing the purge line at the negative pressure;

measuring a first pressure change rate of the purge line;

exposing the purge line to atmospheric air;

sealing the purge line at the atmospheric pressure after passage of a predetermined lag time;

measuring a second pressure change rate of the purge line;

determining a degree of leak based on a difference between the first pressure change rate and the second pressure change rate;

estimating a fuel vapor amount wherein the fuel vapor amount is an amount of fuel vapor produced during a time the first pressure change rate is being measured; and shortening the predetermined lag time as the fuel vapor amount increases.

9. The method of claim 8 wherein sealing the purge line at the negative pressure further comprises closing the purge valve and the cut valve.

10. The method of claim 8 wherein exposing the purge line to the atmosphere further comprises opening the cut valve.

11. The method of claim 8 wherein sealing the purge line at the atmospheric pressure further comprises closing the purge valve and the cut valve.

12. The method of claim 8, further comprising:

increasing the predetermined lag time as the negative pressure of the purge line increases when measurement of the first pressure change rate is completed, the increase of the predetermined lag time being based on the detected pressure.

13. The method of claim 8, further comprising:

detecting a temperature of fuel in the fuel tank; and increasing the predetermined lag time as the fuel temperature increases, the increase in the predetermined lag time being based on the temperature detected.

* * * * *